US011705267B2

(12) United States Patent
Yeo et al.

(10) Patent No.: US 11,705,267 B2
(45) Date of Patent: Jul. 18, 2023

(54) COIL COMPONENT

(71) Applicant: SAMSUNG ELECTRO-MECHANICS CO., LTD., Suwon-si (KR)

(72) Inventors: Jeong Gu Yeo, Suwon-si (KR); Young Il Lee, Suwon-si (KR); Yong Hui Li, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 852 days.

(21) Appl. No.: 16/550,870

(22) Filed: Aug. 26, 2019

(65) Prior Publication Data

US 2020/0335253 A1 Oct. 22, 2020

(30) Foreign Application Priority Data

Apr. 16, 2019 (KR) ..... 10-2019-0044183

(51) Int. Cl.
*H01F 27/28* (2006.01)
*H01F 27/29* (2006.01)
(Continued)

(52) U.S. Cl.
CPC ..... *H01F 27/28* (2013.01); *H01F 27/29* (2013.01); *H01F 27/323* (2013.01); *H01F 41/122* (2013.01); *H01F 1/344* (2013.01)

(58) Field of Classification Search
CPC ..... H01F 27/28; H01F 27/29; H01F 27/323
(Continued)

(56) References Cited

U.S. PATENT DOCUMENTS 9,142,343 B2 * 9/2015 Ohkubo ..... H01F 27/255
10,614,950 B2 * 4/2020 Ahn ..... H01F 27/2823
(Continued)

FOREIGN PATENT DOCUMENTS

CN 102856037 A 1/2013
CN 103915236 A 7/2014
(Continued)

OTHER PUBLICATIONS

Office Action in corresponding Korean Patent Application No. 10-2019-0044183 dated Apr. 14, 2020, with English translation.
(Continued)

*Primary Examiner* — Mang Tin Bik Lian
*Assistant Examiner* — Joselito S. Baisa
(74) *Attorney, Agent, or Firm* — Morgan, Lewis & Bockius LLP

(57) ABSTRACT

A coil component includes a body having one surface and the other surface opposing each other, and one side surface and the other side surface, respectively connecting the one surface and the other surface to each other and opposing each other in one direction, a wound coil embedded in the body, a lead portion extending from an end of the wound coil to one surface of the body and disposed on the one surface of the body, an insulating layer covering one surface of the body and having an opening exposing a portion of the lead portion and extending in the one direction, and an external electrode disposed in the opening and connected to the lead portion. The insulating layer includes finishing portions respectively disposed on opposing sides of the opening in the one direction.

21 Claims, 4 Drawing Sheets

(51) Int. Cl.
*H01F 27/32* (2006.01)
*H01F 41/12* (2006.01)
*H01F 1/34* (2006.01)

(58) Field of Classification Search
USPC ..... 336/192
See application file for complete search history.

(56) References Cited

U.S. PATENT DOCUMENTS

| | | | | |
|---|---|---|---|---|
| 10,617,006 | B2 * | 4/2020 | Uchikoba | H01F 27/02 |
| 10,867,744 | B2 * | 12/2020 | Shinohara | H01F 27/306 |
| 11,017,931 | B2 * | 5/2021 | Kang | H01F 3/10 |
| 11,482,371 | B2 * | 10/2022 | Sato | H01F 27/29 |
| 2003/0024607 | A1 * | 2/2003 | Takemoto | H01F 41/0246 148/309 |
| 2003/0047245 | A1 * | 3/2003 | Takemoto | H01F 41/0246 148/306 |
| 2012/0188040 | A1 * | 7/2012 | Ogawa | H01F 27/027 336/83 |
| 2014/0266533 | A1 * | 9/2014 | Liao | H01F 27/255 336/175 |
| 2015/0023829 | A1 * | 1/2015 | Liao | B22F 7/08 419/8 |
| 2016/0086716 | A1 * | 3/2016 | Choi | H01F 17/0013 427/127 |
| 2016/0155550 | A1 * | 6/2016 | Oh | H01F 1/24 336/233 |
| 2017/0025216 | A1 * | 1/2017 | Liao | B22F 7/08 |
| 2017/0271081 | A1 | 9/2017 | Maki et al. | |
| 2018/0068775 | A1 * | 3/2018 | Kwon | H01F 27/292 |
| 2019/0066900 | A1 | 2/2019 | Nakajima et al. | |
| 2019/0311829 | A1 * | 10/2019 | Kang | H01F 27/02 |
| 2022/0139613 | A1 * | 5/2022 | Yeo | H01F 17/0013 336/199 |

FOREIGN PATENT DOCUMENTS

| | | | | | |
|---|---|---|---|---|---|
| CN | 104700981 | A | * | 6/2015 | H01F 17/0033 |
| CN | 208507409 | U | * | 2/2019 | |
| JP | 3181451 | U | * | 2/2013 | |
| JP | 2017-220573 | A | | 12/2017 | |
| JP | 2019-41032 | A | | 3/2019 | |
| KR | 10-2011-0042151 | A | | 4/2011 | |
| KR | 10-2017-0084156 | A | | 7/2017 | |
| KR | 10-2018-0027982 | A | | 3/2018 | |
| WO | 2010/014444 | A1 | | 2/2010 | |
| WO | 2015/150274 | A1 | | 10/2015 | |

OTHER PUBLICATIONS

Final Notice of Office Action issued in corresponding Korean Patent Application No. 10-2019-0044183 dated Oct. 5, 2020, with English translation.

* cited by examiner

COIL COMPONENT

CROSS-REFERENCE TO RELATED APPLICATION(S)

This application claims the benefit under 35 USC 119(a) of Korean Patent Application No. 10-2019-0044183 filed on Apr. 16, 2019 in the Korean Intellectual Property Office, the entire disclosure of which is incorporated herein by reference for all purposes.

TECHNICAL FIELD

The present disclosure relates to a coil component.

BACKGROUND

As an example of a coil component, a wound coil component, using a magnetic mold and a wound coil, is provided.

In the case of the wound coil component, an insulating layer is formed on the surface of a component to prevent short-circuits, and an opening is formed in the insulating layer such that external electrodes and both ends of the wound coil may be connected to each other.

On the other hand, such an opening is formed by mechanically polishing a portion of an insulating layer formed on the surface of the component. Since the entirety of components of the insulating layer in a width direction are polished, due to mechanical polishing characteristics, and the surface of the component is polished together, insulating characteristics of components may be reduced.

SUMMARY

An aspect of the present disclosure is to provide a coil component having improved insulation characteristics of a body.

According to an aspect of the present disclosure, a coil component includes a body having one surface and the other surface opposing each other, and one side surface and the other side surface, respectively connecting the one surface and the other surface to each other and opposing each other in one direction, a wound coil embedded in the body, a lead portion extending from an end of the wound coil to the one surface of the body and disposed on the one surface of the body, an insulating layer covering the one surface of the body and having an opening exposing a portion of the lead portion and extending in the one direction, and an external electrode disposed in the opening and connected to the lead portion. The insulating layer includes finishing portions respectively disposed on opposing sides of the opening in the one direction.

According to an aspect of the present disclosure, a coil component includes a molded portion having one surface and the other surface facing each other; a wound coil disposed on the other surface of the molded portion; a cover portion disposed on the other surface of the molded portion to cover the wound coil; and a lead portion connected to the wound coil and exposed from the one surface of the molded portion; and an insulating layer disposed on the one surface of the molded portion, and having an opening extending in a width direction of the molded portion to expose a portion of the lead portion. The insulating layer includes finishing portions disposed on opposing sides of the opening in the width direction of the molded portion.

According to an aspect of the present disclosure, a coil component includes a body; a wound coil embedded in the body; a lead portion extending from an end of the wound coil and exposed from one surface of the body; an insulating layer covering the one surface of the body having an opening exposing a portion of the lead portion; and an external electrode disposed in the opening and connected to the lead portion. The body comprises a magnetic metallic powder particle covered by an insulating film, and the insulating film separating the magnetic metallic powder particle from the external electrode is in direct contact with the external electrode.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
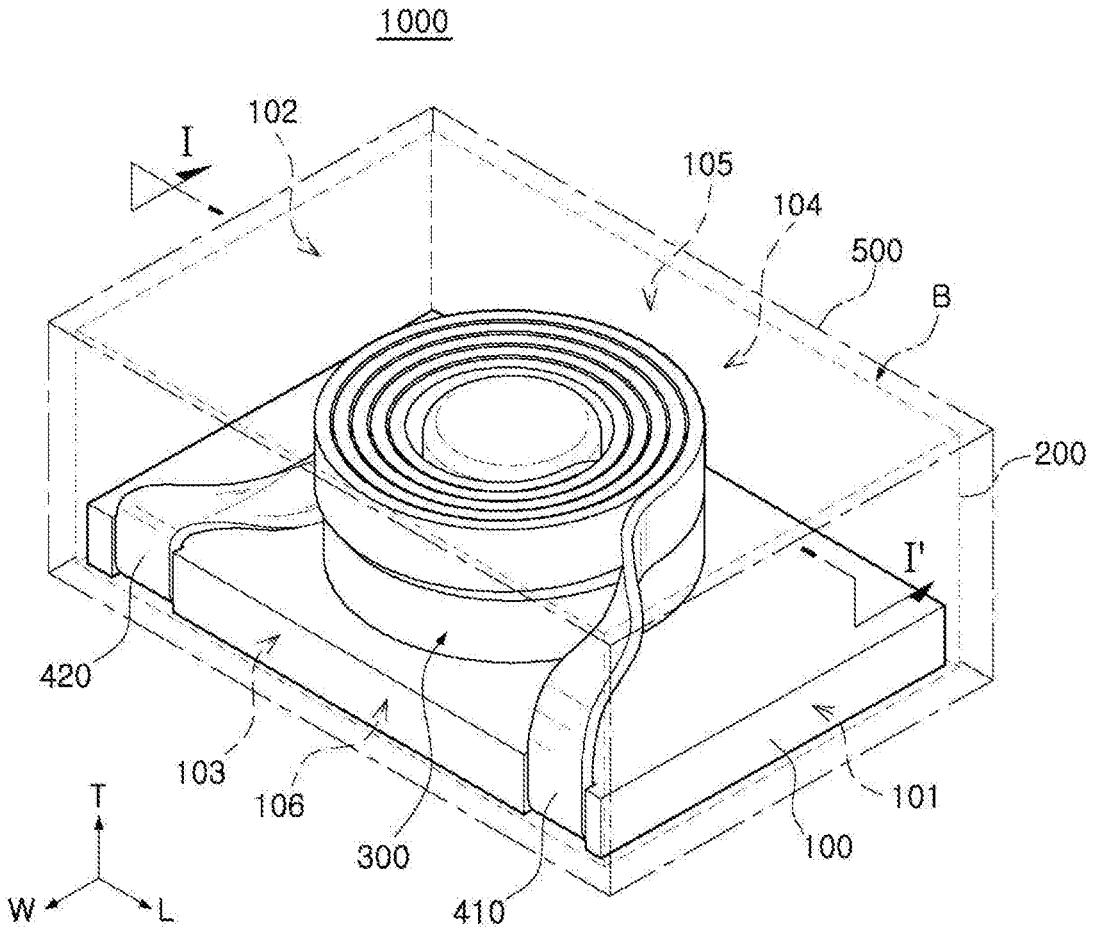
FIG. 1 is a perspective view schematically illustrating a coil component according to an embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that would be well known to one of ordinary skill in the art may be omitted for increased clarity and conciseness.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "including", "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Throughout the specification, it will be understood that when an element, such as a layer, region or wafer (substrate), is referred to as being "on," "connected to," or "coupled to"

another element, it may be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

In addition, the term "coupled" is used not only in the case of direct physical contact between the respective constituent elements in the contact relation between the constituent elements, but also in the case in which other constituent elements are interposed between the constituent elements such that they are in respective contact with each other, being used as a comprehensive concept.

The drawings may not be to scale, and the relative size, proportions, and depiction of elements in the drawings may be exaggerated for clarity, illustration, and convenience.

In the drawing, the L direction may be defined as a first direction or a length direction, the W direction as a second direction or a width direction, and the T direction as a third direction or a thickness direction.

Hereinafter, a coil component according to an embodiment in the present disclosure will be described in detail with reference to the accompanying drawings. Referring to the accompanying drawings, the same or corresponding components are denoted by the same reference numerals, and redundant descriptions thereof will be omitted.

Various types of electronic components are used in electronic devices. Various types of coil components may be suitably used for noise removal or the like between these electronic components.

For example, as a coil component in an electronic device, a power inductor, a high frequency inductor (HF Inductor), a general bead, a bead for high frequency (GHz Bead), a common mode filter, or the like may be used.

Figure 2:
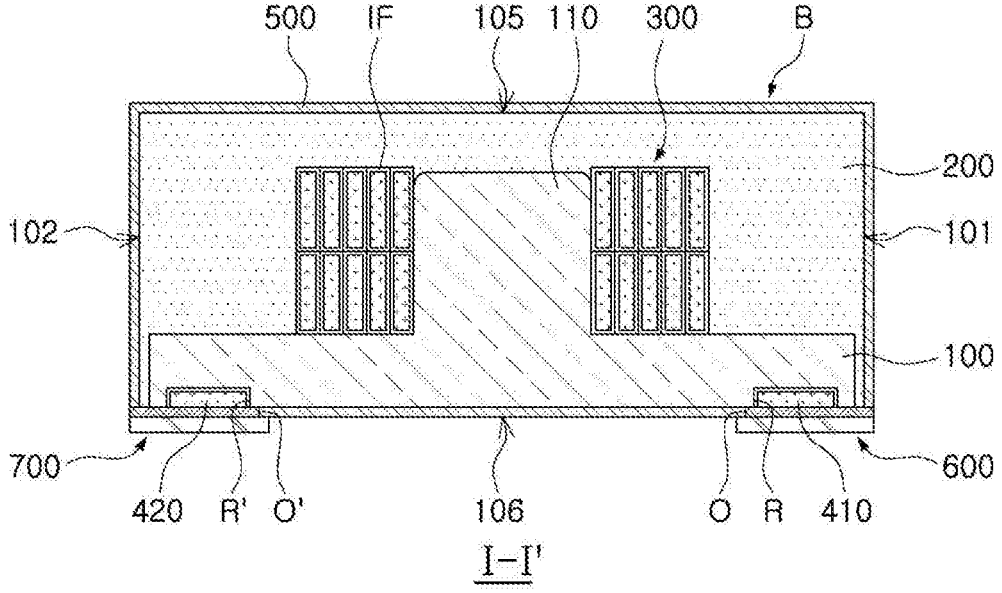
FIG. 2 is a cross-sectional view taken along line I-I' in FIG. 1.
Figure 3:
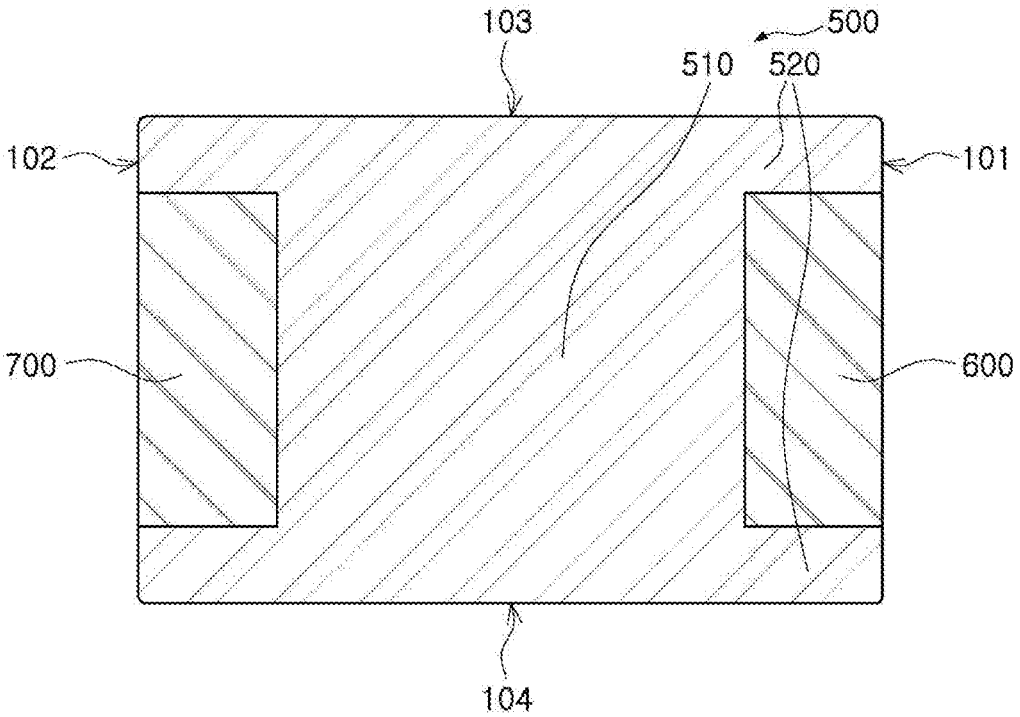
FIG. 3 is a bottom plan view schematically illustrating a coil component according to an embodiment of the present disclosure.
Figure 4:
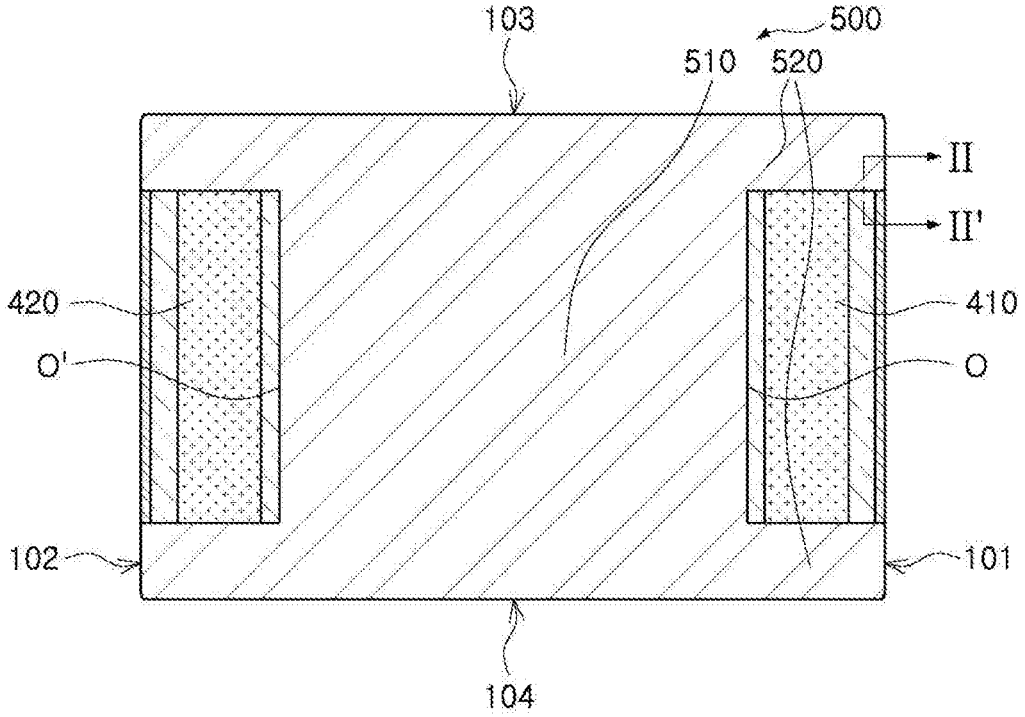
FIG. 4 is a view illustrating a portion of configurations, omitted from FIG. 3.
Figure 5:
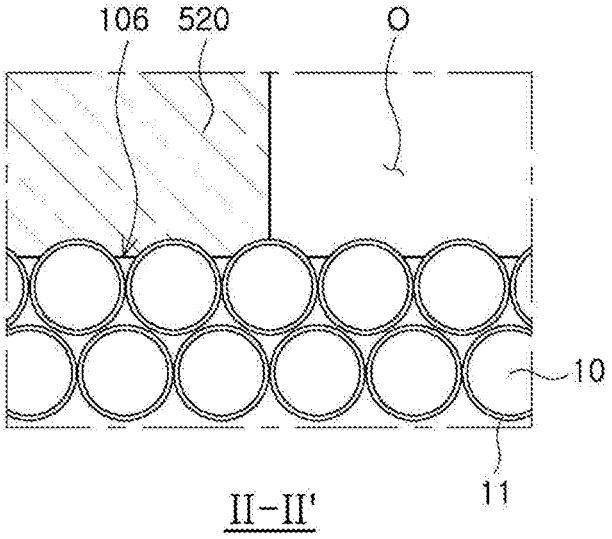
FIG. 5 is a partially enlarged cross-sectional view taken along line II-II' in FIG. 4.
Figure 6:
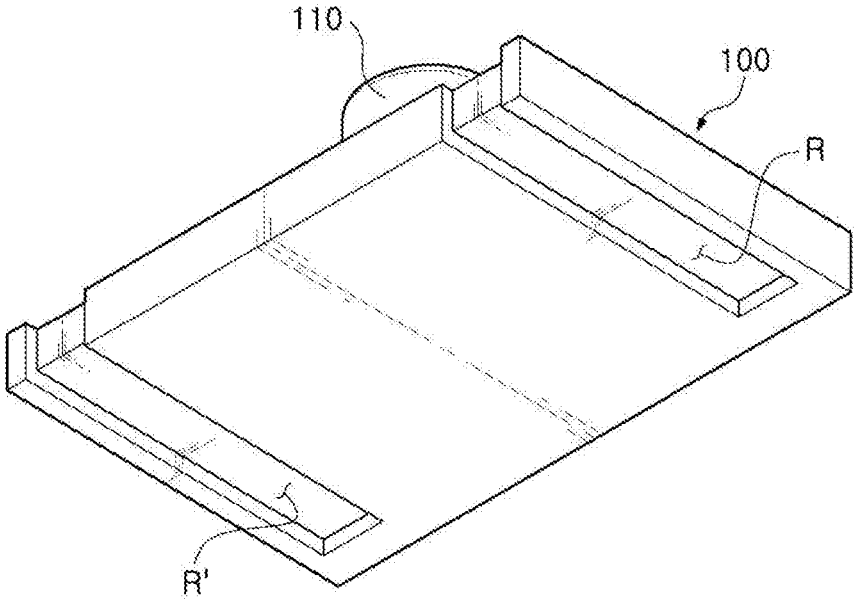
FIG. 6 schematically illustrates a molded portion of FIG. 1.
Figure 7:
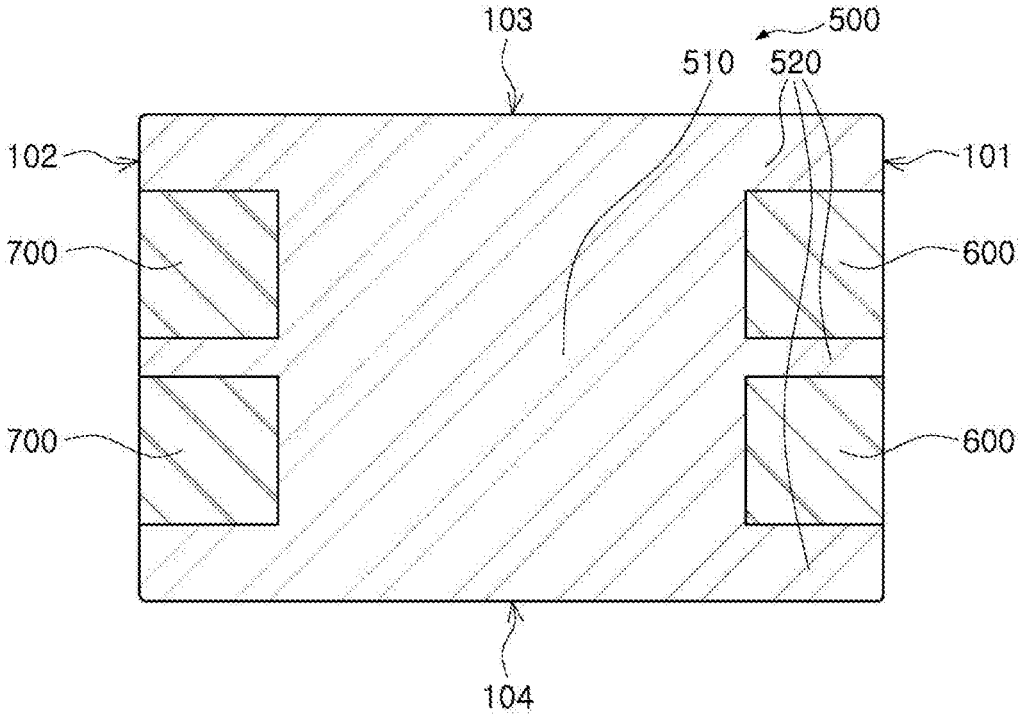
FIG. 7 is a schematic view illustrating a modified example of a coil component according to an embodiment of the present disclosure.

FIG. 1 is a perspective view schematically illustrating a coil component according to an embodiment. FIG. 2 is a cross-sectional view taken along line I-I' in FIG. 1. FIG. 3 is a bottom plan view schematically illustrating a coil component according to an embodiment. FIG. 4 is a view illustrating a portion of configurations, omitted from FIG. 3. FIG. 5 is a partially enlarged cross-sectional view taken along line II-II' in FIG. 4. FIG. 6 schematically illustrates a molded portion of FIG. 1. FIG. 7 is a schematic view illustrating a modified example of a coil component according to an embodiment.

Referring to FIGS. 1 to 7, a coil component 1000 according to an embodiment includes a body B, a wound coil 300, lead portions 410 and 420, an insulating layer 500, openings O and O', and external electrodes 600 and 700. The body B includes a molded portion 100 and a cover portion 200. The molded portion 100 may include a core 110.

The body B forms the exterior of the coil component 1000 according to the embodiment, and the wound coil 300 is embedded in the body B.

The body B may be formed in a hexahedral shape as a whole.

Referring to FIG. 1, the body B has a first surface 101 and a second surface 102 opposing each other in a length direction L, a third surface 103 and a fourth surface 104 opposing each other in a width direction W, and a fifth surface 105 and a sixth surface 106 opposing in a thickness direction T. Each of the first to fourth surfaces 101, 102, 103 and 104 of the body B corresponds to a wall surface of the body B, connecting the fifth surface 105 and the sixth surface 106 of the body B. Both end surfaces of the body B may refer to the first surface 101 and the second surface 102 of the body B, and both side surfaces of the body B may refer to the third surface 103 and the fourth surface 104 of the body B, and one surface and the other surface of the body B may refer to the sixth surface 106 and the fifth surface 105 of the body B, respectively.

The body B may be formed, in such a manner that, the coil component 1000 according to an embodiment, including external electrodes 600 and 700 to be described later, has a length of 2.0 mm or less, a width of 1.2 mm or less, and a thickness of 0.80 mm or less, but an embodiment thereof is not limited thereto.

The body B includes the molded portion 100 and the cover portion 200. The cover portion 200 is disposed on an upper part of the molded portion 100 with reference to FIGS. 1 and 2, to surround all surfaces of the molded portion 100, except for a lower surface of the molded portion 100. Thus, the first to fifth surfaces 101, 102, 103, 104 and 105 of the body B are formed by the cover portion 200, and the sixth surface 106 of the body B is formed by the molded portion 100 and the cover portion 200.

The molded portion 100 has one surface and the other surface facing each other. The molded portion 100 supports the wound coil 300 to be described later, disposed on the other surface. The molded portion 100 includes the core 110. The core 110 is disposed in a central portion of the other surface of the molded portion 100 in such a manner as to penetrate through the wound coil 300. One surface of the molded portion 100 constitutes a portion of the sixth surface 106 of the body B.

The cover portion 200 covers the molded portion 100 and the wound coil 300 to be described later. The cover portion 200 may be disposed on the molded portion 100 and the wound coil 300, to then be pressed to be coupled to the molded portion 100.

At least one of the molded portion 100 and the cover portion 200 includes a magnetic material. In this embodiment, both the molded portion 100 and the cover portion 200 include a magnetic material. As an example, the molded portion 100 may be formed by filling a mold for forming the molded portion 100 with a magnetic material. As another example, the molded portion 100 may be formed by filling a mold with a composite material containing a magnetic material and an insulating resin. A molding process in which a high temperature and a high pressure are applied to the magnetic material or the composite material in the mold may be additionally performed, but an embodiment thereof is not limited thereto. The molded portion 100 and the core 110 may be integrally formed by a mold and may not have a boundary therebetween. The cover portion 200 may be formed by disposing a magnetic composite sheet in which a magnetic material is dispersed in an insulating resin on the molded portion 100 and the wound coil 300, followed by heating and pressing.

The magnetic material may be ferrite or a magnetic metallic powder particle 10.

Ferrite powder may be formed of one or more of spinel type ferrite such as Mg—Zn type, Mn—Zn type, Mn—Mg type, Cu—Zn type, Mg—Mn—Sr type, Ni—Zn type or the like, hexagonal ferrite such as Ba—Zn, Ba—Mg, Ba—Ni, Ba—Co, Ba—Ni—Co type, or the like, garnet type ferrite such as Y type or the like, and Li-based ferrite.

The magnetic metallic powder particle 10 may include one or more selected from the group consisting of iron (Fe), silicon (Si), chromium (Cr), cobalt (Co), molybdenum (Mo), aluminum (Al), niobium (Nb), copper (Cu), and nickel (Ni).

For example, the magnetic metallic powder particle 10 may be at least one or more of pure iron powder, Fe—Si alloy powder, Fe—Si—Al alloy powder, Fe—Ni alloy powder, Fe—Ni—Mo alloy powder, Fe—Ni—Mo—Cu alloy powder, Fe—Co alloy powder, Fe—Ni—Co alloy powder, Fe—Cr alloy powder, Fe—Cr—Si alloy powder, Fe—Si—Cu—Nb alloy powder, Fe—Ni—Cr alloy powder, and Fe—Cr—Al alloy powder.

In the following description, a case in which the magnetic metallic powder particle 10 is a magnetic metallic powder is described, but an embodiment thereof is not limited thereto.

The magnetic metallic powder particle 10 may be amorphous or crystalline. For example, the magnetic metallic powder particle 10 may be an Fe—Si—B—Cr amorphous alloy powder, but is not limited thereto.

The magnetic metallic powder particle 10 may have an average diameter of about 0.1 μm to 30 μm, but the particle size thereof is not limited thereto.

An insulating film 11 is formed on the surface of the magnetic metallic powder particle 10. The magnetic metallic powder particle 10 has conductivity, and the insulating film 11 surrounds the surface of the magnetic metallic powder particle 10 to prevent short-circuiting of the magnetic metallic powder particle 10. The insulating film 11 may include, but is not limited to, epoxy, polyimide, a liquid crystal polymer, or the like, alone or in combination. For example, as long as the insulating film 11 may be formed on the surface of the magnetic metallic powder particle 10 with an electrically insulating material, a material and a forming method thereof may be variously changed.

Each of the molded portion 100 and the cover portion 200 may include two or more kinds of magnetic materials. In this case, the term "different kinds of magnetic materials" means that magnetic materials are distinguishable from each other by any one of an average diameter, a composition, a crystallinity, and a shape.

The insulating resin may include, but is not limited to, an epoxy, a polyimide, a liquid crystal polymer, or the like, alone or in combination.

The wound coil 300 is embedded in the body B to exhibit characteristics of a coil component. For example, when the coil component 1000 according to the embodiment is used as a power inductor, the wound coil 300 may function to stabilize power supply of an electronic device by storing an electric field as a magnetic field to maintain an output voltage.

The wound coil 300 is disposed on the other surface of the molded portion 100. In detail, the wound coil 300 is disposed on the other surface of the molded portion 110 in the form of being wound around the core 110.

The wound coil 300 is an air-core coil, and may be composed of a rectangular coil. The wound coil 300 may be formed by spirally winding a metal wire such as a copper wire of which a surface is covered with an insulating film IF. As a result, the wound coil 300 in turns is covered with the insulating film IF.

The wound coil 300 may be composed of a plurality of layers. Each layer of the wound coil 300 is formed in a flat spiral shape, to have a plurality of turns. For example, the wound coil 300 forms an innermost turn, at least one middle turn, and an outermost turn from the center of the other surface of the molded portion 100.

The lead portions 410 and 420 extend from one end of the wound coil 300 to one surface 106 of the body B, and are disposed in one direction W on one surface 106 of the body B. In detail, the first lead portion 410 extends from one end of the wound coil 300 to the sixth surface 106 of the body B. The second lead portion 420 extends from the other end of the wound coil 300 to the sixth surface 106 of the body B. The first and second lead portions 410 and 420 have the form respectively extending from the sixth surface 106 of the body B in the width direction W of the body B, and are spaced apart from each other in the length direction L of the body B on the sixth surface 106 Of the body B. The first and second lead portions 410 and 420 may be the rest remaining after the wound coil 300 is formed of a metal wire such as a copper wire of which a surface is coated with an insulating film IF. As a result, no boundary is formed between the first and second lead portions 410 and 420 and the wound coil 300. In addition, similarly to the wound coil 300, the insulating film IF is formed on the surfaces of the first and second lead portions 410 and 420. A portion of the insulating films IF of the first and second lead portions 410 and 420 may be removed for connection between the first and second lead portions 410 and 420 and the external electrodes 600 and 700.

The first and second lead portions 410 and 420 are exposed to the sixth surface 106 of the body B. As illustrated in FIGS. 2 and 6 as an example, the molded portion 100 is provided with grooves R and R' formed along a side surface and one surface of the molded portion 100, and the first and second lead portions 410 and 420 may be disposed in the grooves R and R', respectively. The first lead portion 410 and the second lead portion 420 extend from the wound coil 300 outwardly towards one of the third and fourth surfaces 103 and 104 to pass the grooves R and R', respectively, such that end portions of the first lead portion 410 and the second lead portion 420 are exposed from the sixth surface 106. Since the cover portion 200 fills portions of the grooves R and R' to cover portions of the first lead portion 410 and the second lead portion 420 disposed in the grooves R and R', the second lead portion 420 are spaced apart from the third and fourth surfaces 103 and 104. Although the embodiment shows that the grooves R and R' are disposed on a same side of the molded portion 100 (e.g., both adjacent to the third surface 103), the present disclosure is not limited thereto. For example, the grooves R and R' may be formed on opposite sides of the molded portion 101, one adjacent to the third surface 103 and the other adjacent to the fourth surface 104. In this case, the first lead portion 410 and the second lead portion 420 may extend from the wound coil 300 outwardly towards the third and fourth surfaces 103 and 104 to pass the grooves R and R', respectively. As another example, the grooves R and R' may have a form of a through hole structure penetrating through the molded portion 100, such that the first and second lead portions 410 and 420 may penetrate through the molded portion 100 to be exposed through one surface of the molded portion 100. The grooves R and R' may be formed in a process of forming the molded portion 100 with a mold or may be formed in the molded portion 100 in a process of pressing the cover portion 200. In the latter case, the grooves R and R' are formed to have a shape corresponding to that of the lead portions 410 and 420.

The insulating layer 500 covers one surface 106 of the body B. Further, the insulating layer 500 may also be disposed on the first to fifth surfaces 101, 102, 103, 104 and 105 of the body B. The insulating layer 500 disposed on the first to fifth surfaces 101, 102, 103, 104 and 105 of the body B, and the insulating layer 500 disposed on the sixth surface 106 of the body B, may be formed in the same process and of the same material, and thus, may not have distinguishable boundaries therebetween, but an embodiment thereof is not limited thereto. For example, the insulating layer 500 formed on the first to fourth surfaces 101, 102, 103 and 104 of the body B and the insulating layer 500 formed on the sixth surface 106 of the body B may be formed in different processes to have a boundary formed therebetween.

The openings O and O' are disposed in the insulating layer 500 to expose portions of the lead portions 410 and 420 on the sixth surface 106 and extend in the width direction W. The external electrodes 600 and 700 to be described later are formed in the openings O and O', and the external electrodes 600 and 700 and the lead portions 410 and 420 are connected to each other. The openings O and O' may be formed by removing a portion of the insulating layer 500 to expose a portion of each of the lead portions 410 and 420 disposed on the sixth surface 106 of the body B. The openings O and O' do not extend to both ends of the insulating layer 500 in the width direction W, and thus expose a portion of each of the lead portions 410 and 420. As a result, in the case of this embodiment, the insulating layer 500 includes a central portion 510 disposed between the external electrodes 600 and 700 to be described later, and finishing portions 520 disposed on outer sides of both end portions of the openings O and O' facing each other in the width direction W, respectively. The external electrodes 600 and 700 do not extend to the edge regions between the sixth surface 106 and the third and fourth surfaces 103 and 104 of the body B. That is, the external electrodes 600 and 700 are spaced apart from the edge regions between the sixth surface 106 and the third and fourth surfaces 103 and 104 of the body B.

The openings O and O' may be formed in the insulating layer 500 by a process such as laser, sandblasting or the like. In the case of the related art mechanical polishing, only a portion of the insulating layer 500 between both ends of the insulating layer 500 in the width direction W may not be selectively removed. While, in the case of the above-described laser or sandblasting, only a portion of the insulating layer 500 between both ends of the insulating layer 500 in the width direction W may be selectively removed.

Referring to FIG. 5, in this embodiment, the insulating film 11 remains on the surface of the magnetic metallic powder particle 10, exposed on the sixth surface 106 of the body B. In forming the openings by mechanical polishing, a portion of each of the magnetic metallic powder particle 10 and the insulating film 11 exposed on the sixth surface 106 of the body B is removed together with a portion of the insulating layer 500. In this case, a breakdown voltage (BFD) of the body B decreases, which may lower reliability of components. However, in this embodiment as described above, since the openings O and O' are formed in the insulating layer 500 using laser or sandblasting, only the insulating layer 500 may be selectively removed. As a result, the magnetic metallic powder particle 10 exposed on the sixth surface 106 of the body B and the insulating film 11 on the surface of the magnetic metallic powder particle 10 do not deform, such that reliability of components may be improved. This insulating film 11 is different from the insulating layer formed separately to cover the magnetic metallic powder particle 10 exposed externally after the insulating film 11 of the magnetic metallic powder particle 10 is removed due to the related art mechanical polishing. As an example, since such an insulating layer is bounded by the insulating film 11, the insulating layer and the insulating film 11 may be distinguishable from each other as described above.

The external electrodes 600 and 700 are disposed in the openings O and O' to be connected to the lead portions 410 and 420, respectively. In this case, the external electrodes 600 and 700 filling the openings O and O' are in contact with the the insulating film 11 of the magnetic metallic powder particle 10. Since the insulating film 11 on the magnetic metallic powder particle 10 is remained after selectively removing the insulating layer 500 by laser or sandblasting, the insulating film 11 is in direct contact with a portion of the external electrodes 600 and 700 disposed thereon. In detail, the first external electrode 600 is disposed in the opening O to be connected to the first lead portion 410, and the second external electrode 700 is disposed in the opening O' to be connected to the second lead portion 420. The first and second external electrodes 600 and 700 are spaced apart from each other on the sixth surface 106 of the body B.

The first and second external electrodes 600 and 700 may be formed of a material selected from the group consisting of conductive materials such as copper (Cu), aluminum (Al), silver (Ag), tin (Sn), gold (Au), nickel (Ni), lead (Pb), chromium (Cr), titanium (Ti), alloys thereof, or the like, but a material thereof is not limited thereto.

The first and second external electrodes 600 and 700 may have a structure of a single layer or a plurality of layers. For example, the first external electrode 300 may be comprised of a first layer including copper (Cu), a second layer disposed on the first layer and including nickel (Ni), and a third layer disposed on the second layer and including tin (Sn). Each of the first to third layers may be formed by electroplating, but an embodiment thereof is not limited thereto. Each of the first and second external electrodes 600 and 700 may include a conductive resin layer and an electroplating layer. The conductive resin layer may be formed by applying and curing a conductive powder containing silver (Ag) and/or copper (Cu) and a conductive paste containing an insulating resin such as epoxy or the like.

At least a portion of the external electrodes 600, 700 may extend onto the insulating layer 500. As an example, in the case in which the external electrodes 600 and 700 include the conductive resin layer and the electroplating layer, after the conductive resin layer is formed to fill at least a portion of the openings O and O', the electroplating layer may be formed on the insulating layer 500. In this case, the electroplating layer fills the remaining volume of the openings O and O' and then extend onto the insulating layer 500, due to plating spreading. When at least a portion of the external electrodes 600 and 700 extends onto the insulating layer 500, exposed areas of the external electrodes 600 and 700 are increased, and bonding force with solder or the like may thus be increased during mounting.

Referring to FIG. 7, each of the external electrodes 600 and 700 may be formed as a plurality of external electrodes, spaced apart from each other in the width direction W of the body B. In detail, in this modified example, each of the openings O and O' may be formed as a plurality of openings, spaced apart from each other in the width direction W in the insulating layer 500. In this case, the external electrodes 600 and 700 may be formed in the plurality of openings O and O', respectively, such that each of the external electrodes 600 and 700 are provided as the plurality of the external electrodes 600 and 700, spaced apart from each other in the width direction W of the body B. In this case, the finishing portion 520 of the insulating layer 500 is disposed not only on outer sides of outermost openings O and O' in the width direction W, but also between the plurality of openings O and O'. In this modified example, an actual area of the exposed surface of the external electrodes 600 and 700 may be reduced while maintaining an effective area of the exposed surface of the external electrodes 600 and 700. Therefore, the total volume of solder may be reduced while maintaining mounting reliability between substrates, in the case of mounting on a mounting substrate.

As set forth above, according to an embodiment, insulation characteristics of a body may be improved.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a body having one surface and the other surface opposing each other, and one side surface and the other side surface, respectively connecting the one surface and the other surface to each other and opposing each other in one direction;

a wound coil embedded in the body;

a lead portion extending from an end of the wound coil to the one surface of the body and disposed on the one surface of the body;

an insulating layer covering the one surface of the body, and having an opening exposing a portion of the lead portion and extending in the one direction; and an external electrode disposed in the opening and connected to the lead portion, wherein the insulating layer includes first finishing portions respectively disposed on opposing sides of the first opening in the one direction, and a portion of the first finishing portions is in contact with the lead portion.

2. The coil component of claim 1, wherein the insulating layer further includes a second opening exposing another portion of the lead portion, the first and second openings disposed in the one direction.

3. The coil component of claim 2, wherein the insulating layer further includes a second finishing portion disposed between the first and second openings.

4. The coil component of claim 2, wherein the external electrode includes first and second external electrodes respectively disposed in the first and second openings.

5. The coil component of claim 1, wherein the body comprises a magnetic metallic powder particle, and an exposed surface of the magnetic metallic powder particle exposed to a region of one surface of the body, the region corresponding to the opening, is provided with an insulating film disposed thereon.

6. The coil component of claim 5, wherein the insulating film surrounds a surface of the magnetic metallic powder particle.

7. The coil component of claim 1, wherein the body comprises a magnetic metallic powder particle covered by an insulating film which separates the magnetic metallic powder particle from the insulating layer.

8. The coil component of claim 7, wherein the insulating film separating the magnetic metallic powder particle from the insulating layer is in direct contact with the insulating layer.

9. The coil component of claim 1, wherein the body comprises a magnetic metallic powder particle covered by an insulating film which is exposed by the opening.

10. The coil component of claim 9, wherein the insulating film separates the magnetic metallic powder particle from the external electrode and is in direct contact with the external electrode.

11. The coil component of claim 1, wherein at least a portion of the external electrode extends onto the insulating layer.

12. The coil component of claim 1, wherein a groove corresponding to the lead portion is disposed in one surface of the body.

13. The coil component of claim 1, wherein the body comprises a molded portion and a cover portion disposed on the molded portion, and the wound coil is disposed between the molded portion and the cover portion.

14. The coil component of claim 1, wherein the insulating layer covers the one side surface and the other side surface, the other surface, and end surfaces connecting the one side surface and the other side surface to each other.

15. The coil component of claim 1, wherein an area of the external electrode on the one surface of the body is greater than an area of the lead portion on the one surface of the body.

16. A coil component comprising:

a molded portion having one surface and the other surface facing each other;

a wound coil disposed on the other surface of the molded portion;

a cover portion disposed on the other surface of the molded portion to cover the wound coil;

a lead portion connected to the wound coil and exposed from the one surface of the molded portion; and an insulating layer disposed on the one surface of the molded portion, and having an opening extending in a width direction of the molded portion to expose a portion of the lead portion, wherein the insulating layer includes finishing portions disposed on opposing sides of the opening in the width direction of the molded portion, and a portion of the finishing portions is in contact with the lead portion.

17. The coil component of claim 16, wherein the molded portion has a groove, in which the lead portion is disposed, and the cover portion is disposed in a portion of the groove to cover the lead portion.

18. A coil component comprising:

a body;

a wound coil embedded in the body;

a lead portion extending from an end of the wound coil and exposed from one surface of the body;

an insulating layer covering the one surface of the body having an opening exposing a portion of the lead portion; and an external electrode disposed in the opening and connected to the lead portion, wherein the body comprises a magnetic metallic powder particle covered by an insulating film, and a portion of the insulating film, which separates the magnetic metallic powder particle from the external electrode and is in contact with the external electrode, and another portion of the insulating film, which is disposed in the body and is spaced apart from the external electrode, include the same material.

19. The coil component of claim 18, wherein at least a portion of the external electrode extends onto the insulating layer.

20. The coil component of claim 18, wherein the insulating layer covers each of entirely of other surfaces of the body except the one surface.

21. The coil component of claim 18, wherein the external electrode is spaced apart from opposing edges of the one surface in a width direction of the coil component.

* * * * *